US005230358A

United States Patent [19]

Forell

[11] Patent Number: 5,230,358

[45] Date of Patent: Jul. 27, 1993

[54] FOLDABLE TENT AND FRAME THEREFOR

[75] Inventor: Milton D. Forell, Clackamas, Oreg.

[73] Assignee: Insta Tent Frames, Inc., West Linn, Oreg.

[21] Appl. No.: 566,810

[22] Filed: Jul. 19, 1990

Related U.S. Application Data

[63] Continuation of Ser. No. 321,735, Mar. 10, 1989, abandoned.

[51] Int. Cl.[5] ..... E04H 15/28

[52] U.S. Cl. ..... 135/98; 135/104

[58] Field of Search ..... 135/98, 20 M, 104, 105, 135/22

[56] References Cited

U.S. PATENT DOCUMENTS

| | | | |
|---|---|---|---|
| 48,308 | 6/1865 | Price | 135/98 |
| 998,462 | 7/1911 | Barch | 135/98 |
| 2,864,389 | 12/1958 | Smith | 135/98 |
| 2,953,145 | 9/1960 | Moss | 135/98 |
| 3,738,378 | 6/1973 | Williams | 135/98 |
| 3,744,503 | 7/1973 | Wolff | 135/20 M |
| 3,794,054 | 2/1974 | Watts | 135/98 |
| 3,874,397 | 4/1975 | Oberhaas | 135/98 |
| 3,929,146 | 12/1975 | Maiken | 135/98 |
| 4,074,682 | 2/1978 | Yoon | 135/20 M |
| 4,131,954 | 1/1979 | Brock | 135/98 |
| 4,202,363 | 5/1980 | Watts | 135/98 |
| 4,327,520 | 5/1982 | Saxby | 135/98 |
| 4,572,226 | 2/1986 | Williams | 135/20 M |
| 5,117,851 | 6/1992 | Chang | 135/98 |

FOREIGN PATENT DOCUMENTS

| | | | |
|---|---|---|---|
| 750895 | 8/1933 | France | 135/98 |
| 451384 | 9/1949 | Italy | 135/98 |
| 599441 | 11/1958 | Italy | 135/98 |
| 450887 | 7/1936 | United Kingdom | 135/98 |
| 2185273 | 7/1987 | United Kingdom | 135/98 |

*Primary Examiner*—Henry E. Raduazo
*Attorney, Agent, or Firm*—Olson & Olson

[57] ABSTRACT

A foldable tent frame utilizes an upper spider to secure a plurality of pivoted lengths which anchor the upper sections of a like number of tent frame legs. The leg anchor lengths are connected pivotally intermediate their ends to one end of a like number of lower lengths the opposite ends of which are connected pivotally to a lower spider. Drive mechanism interconnects the upper and lower spiders to move the lower spider toward and away from the upper spider to effect erection and collapse, respectively, of the tent frame. The drive mechanism includes locking mechanism for securing the spider assembly in the erected condition of the frame. Intermediate and lower leg sections are hinged together and joined to each of the upper leg sections. The hinges are configured to allow folding of the lower leg section parallel to the outer side of the associated intermediate section and then folding of the folded assembly of lower and intermediate leg sections parallel to the outer side of the associated upper leg section.

12 Claims, 5 Drawing Sheets

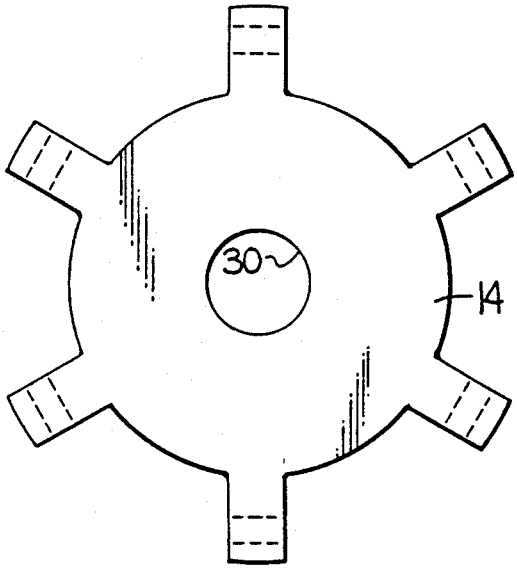
FIG. 5
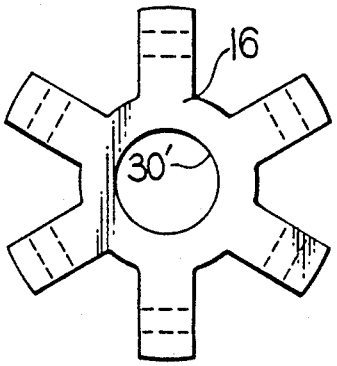
FIG. 6
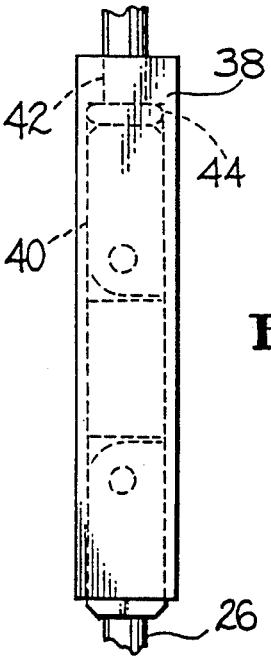
FIG. 10
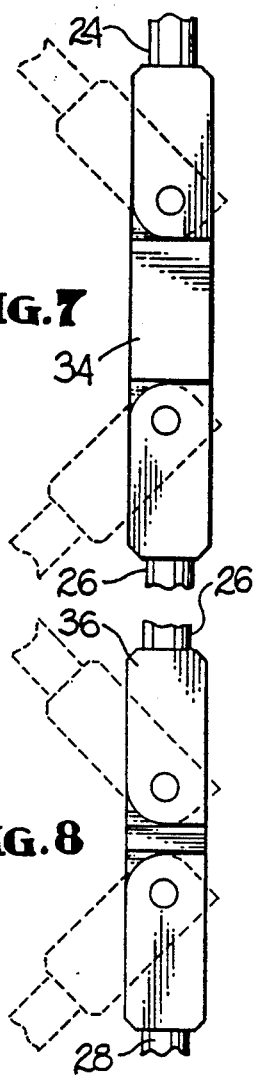
FIG. 7
FIG. 8
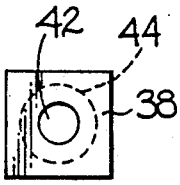
FIG. 11
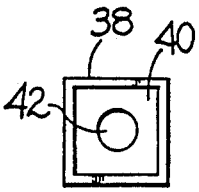
FIG. 12
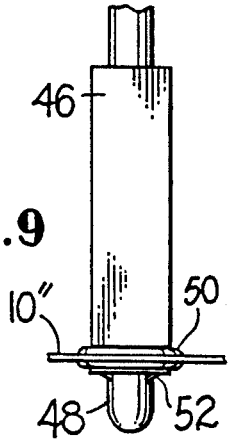
FIG. 9

FOLDABLE TENT AND FRAME THEREFOR

This application is a continuation of application Ser. No. 07/321,735, filed Mar. 10, 1989 now abandoned.

BACKGROUND OF THE INVENTION

This invention relates to tents, and more particularly to a foldable tent frame which allows the tent to be erected to a secure position and folded to compact dimensions in less than one minute.

There are many foldable tent constructions which afford rapid erection and folding. For example, in U.S. Pat. Nos. 3,929,146, and 3.794,054 the construction utilizes an over-center brace arrangement allowing rapid erection and folding. Although the over-center brace arrangement secures the tent in erected condition under most circumstances, inadvertent excessive loading or application of other external forces on the tent may result in its automatic collapse.

Other tent constructions provide positive locking in the erected condition. However, they are complex and costly structural arrangements, some of which impose limits on the size, type and utility of the tent. Typical of these are the constructions disclosed in U.S. Pat. Nos. 4,750,509; 4,478,234; 4,202,363; 3,874,397; and 3,738,378.

SUMMARY OF THE INVENTION

This invention provides a tent frame which utilizes interlinked upper and lower spider members to fold and unfold a plurality of tent cover-supporting legs, and provides releasable locking mechanism by which to secure the spiders together to positively lock the tent in erected condition.

It is the principal objective of this invention to provide a foldable tent frame that affords erection of the tent to a secure position and folding to compact size with speed and facility.

Another object of this invention is the provision of a foldable tent frame of the class described which utilizes a simplified actuating mechanism for erecting and collapsing the tent frame.

Still another objective of this invention is to provide a foldable tent frame of the class described which accommodates the support of a tent cover inside or outside the frame, as desired.

A further objective of this invention is the provision of a foldable tent frame of the class described that is made of a minimum number of parts many of which are duplicates of each other, whereby to minimize manufacturing time and cost.

The foregoing and other objects and advantages of this invention will appear from the following detailed description, taken in connection with the accompanying drawings of preferred embodiments.

BRIEF DESCRIPTION OF THE DRAWINGS

FIG. 5 is a plan view of the upper spider member of this invention for a tent frame having six pivoting leg members.

FIG. 6 is a plan view of the smaller, lower spider member associated with the upper spider member shown in the FIG. 5.

FIG. 7 is a fragmentary side elevation of an upper leg hinge.

FIG. 8 is a fragmentary side elevation of a lower leg hinge.

FIG. 9 is a side elevation of a leg end cap showing its attachment to the bottom terminal end of a leg to secure the leg to the floor of a tent cover.

FIG. 10 is a fragmentary side elevation of a releasable hinge lock sleeve in position overlying and securing a hinge in extended condition.

FIG. 11 is a plan view of the top of the hinge lock sleeve shown in FIG. 10.

FIG. 12 is a bottom view of the locking sleeve of FIG. 10.

DESCRIPTION OF THE PREFERRED EMBODIMENT

Figure 1:
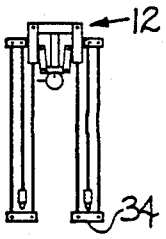
FIGS. 1–4 are schematic side views of a tent frame embodying the features of this invention in various, progressive stages of erection, the tent cover shown in broken lines in FIG. 4 being omitted in FIGS. 1–3 in order to provide an unobstructed view of the frame.
Figure 2:
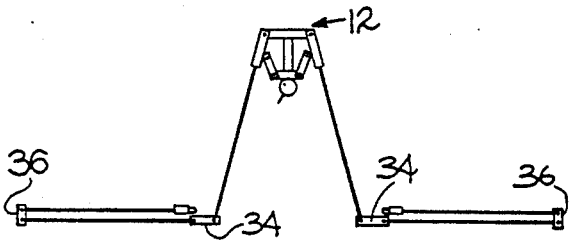
Figure 3:
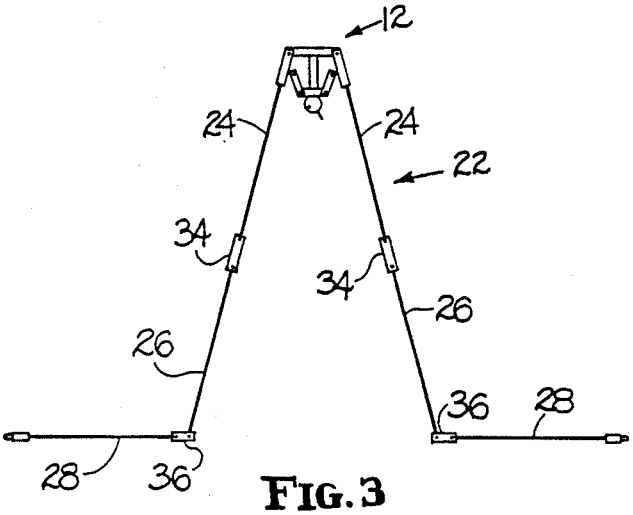

The foldable tent of this invention comprises a framework which supports a tent cover 10. The tent cover may be a conventional tent cover or it may be one designed particularly for the framework of this invention. The preferred framework contemplates using standard, available tent covers which require no significant modification thereto for use with the framework disclosed herein. The framework may also support the tent cover on the inside or the outside of the frame as desired.

The framework includes a top base assembly, indicated generally as 12, comprising an upper spider member 14 and a lower spider member 16 (FIGS. 5 and 6) pivotally interconnected by a plurality of circumferentially spaced apart, hinged lower link members 18. Each lower link member 18 is pivotally attached at its bottom end to the lower spider 16, and pivotally at its upper end to an upper, leg-mounting link member 20 which is itself pivotally attached to the upper spider 14 as shown. The spider members shown are configured to mount six pivotal upper link members, but it is to be understood that any other number of link members may be provided, depending on the configuration of the spider members 14, 16. The upper links 20 each mount a tent cover-supporting leg member 22 formed of a plurality of hinged leg sections 24, 26, 28. The leg sections themselves are formed of preferably lightweight, strong but resilient material such as glass-fiber-reinforced synthetic resin, aluminum tubing, or other material that may be suitable for leg construction.

In the embodiments illustrated, the spiders 14, 16 each include a centrally disposed bore 30, 30' therethrough, respectively, which, in each of the various embodiments illustrated, receive alternative drive and locking means, to be described later, arranged to mechanically move the lower spider member 16 toward and away from the upper spider member 14 to accomplish erection and collapse of the framework.

FIGS. 1–4 schematically illustrate the foldable tent and framework of this invention in various progressive stages of erection. It is to be understood that the tent cover 10, illustrated in broken lines in FIG. 4, has been omitted from FIGS. 1–3 merely for clarity of the drawings, and normally would remain attached to the framework and be folded up along with the framework into the storage condition of FIG. 1.

As will be understood, the erection of the tent basically involves the unfolding (FIGS. 1–3) of the plurality of legs 22, which are attached, by conventional tent straps 32, to the side walls 10' and floor 10" of the tent cover 10, and then lifting upward on the top base assembly 12. The drive means, to be described later, is then operated to pivot link members 18, and hence leg-mounting link members 20, outward into the extended position shown in FIG. 4 to extend the legs 22 radially outward, and thereby supply supporting tension against the now fully taut tent cover attached thereto.

Figure 4:
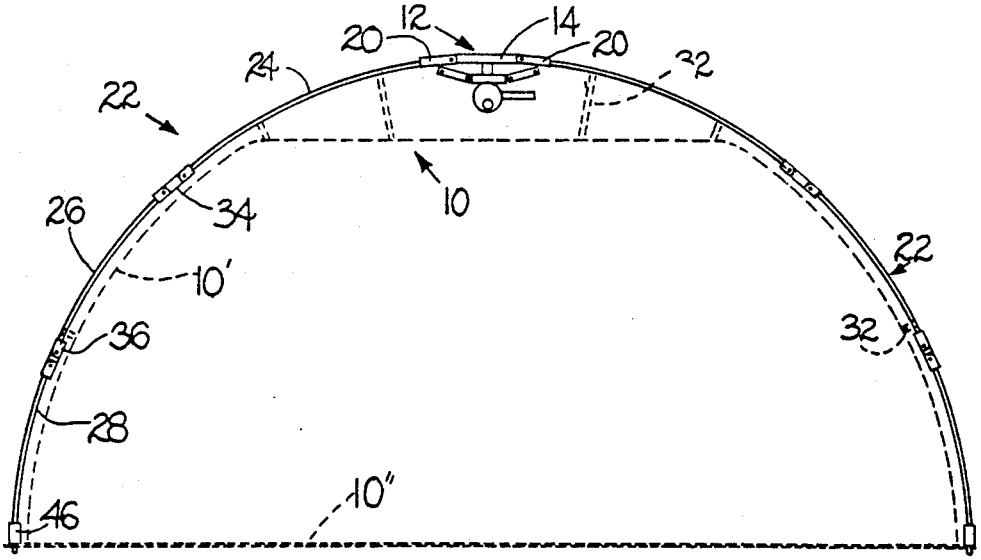

As illustrated in FIGS. 1–4, the leg sections 24, 26, 28 are connected together by hinge members 34, 36, also shown in closer detail in FIGS. 7 and 8. As will be appreciated, the upper leg hinge 34 is configured with a greater distance between the hinge pivots than the lower hinge member 36, in order that the leg sections and tent cover material will fold more compactly into the storage condition of FIG. 1. Both hinges fold in only one direction between pivoted condition and extended condition. This is necessary so that the leg sections will not buckle inwardly under the tension exerted upon them when in erected condition, as seen in FIG. 4.

FIGS. 10, 11 and 12 illustrate one embodiment of a hinge lock 38 which may be provided in order to releasably secure the hinges 34, 36 in extended condition so as to avoid the possible occurrence of inadvertant pivoting of the hinges and subsequent collapse of the framework in very high winds, snow and other eventualities. Basically, the hinge lock comprises a hollow sleeve member configured with an enlarged, interior portion 40 (FIG. 12) arranged to be slid down over the hinge and confine the latter against pivoting. One end of the sleeve member is configured with a reduced opening 42 (FIG. 11) preferably dimensioned to frictionally engage a leg section for inhibited sliding movement of the sleeve along the leg section. The reduced opening 42 forms an abutment against the hinge and thereby prevents the sleeve from sliding further downward and disengaging from the hinge. An O-ring 44 or other conventional friction means may be provided to frictionally engage the leg section to hold the sleeve on the leg away from the hinge when it is not desired or needed that the hinge be locked.

As also seen in FIGS. 1–4, the bottom end of the lower leg sections 28 each mount an end cap 46 which comprises a fitting having a bottom section of reduced diameter forming a peg 48 configured to fit through a conventional grommet 50 normally provided about the outer edge of a tent cover floor 10" or on a tab (not shown) attached to the bottom edge of a tent cover wall. A friction washer 52 is pressed onto the peg to capture the grommet 50 on the peg between the washer 52 and the enlarged section of the end cap, as shown, thus securing the tent cover to the terminal end of the legs. The bottom of the legs are thus secured to the bottom perimeter of a tent cover, the legs, thus confined, being sized appropriately to provide the desired amount of flexing and bowing, and hence tension, to adequately support the tent when the tent is fully erected to the condition of FIG. 4.

With the basic construction of the foldable tent frame of this invention thus generally understood, attention is now directed to the top base assembly 12, various alternative embodiments of which are illustrated in FIGS. 13–14, 15–17 and 18–21. The top base assembly mounts all of the tent supporting leg members 22, as previously explained, and also includes drive and locking means configured to mechanically tension the leg members into tent-supporting, erected condition and to maintain the leg members releasably but securely in such tension condition. As explained earlier, the top base assembly 12 includes an upper spider member 14 and a lower spider member 16, the upper spider pivotally mounting the upper links 20 which in turn mount the legs 22. The lower spider 16 is connected pivotally to the upper links through lower pivot links 18, and the upper and lower spiders are interconnected directly together through a drive mechanism received, in the disclosed embodiments, by a centrally located bore 30, 30' respectively, provided through each spider member. Accordingly, movement of the lower spider vertically toward and away from the top member 14 effects pivoting movement of the leg-mounting upper link members 20 about their pivot attachment to the upper spider outwardly or inward respectively, and hence also moves the leg members extending from the link members. The foregoing basic top base assembly construction is common to all of the preferred embodiments now to be explained in closer detail.

Figure 13:
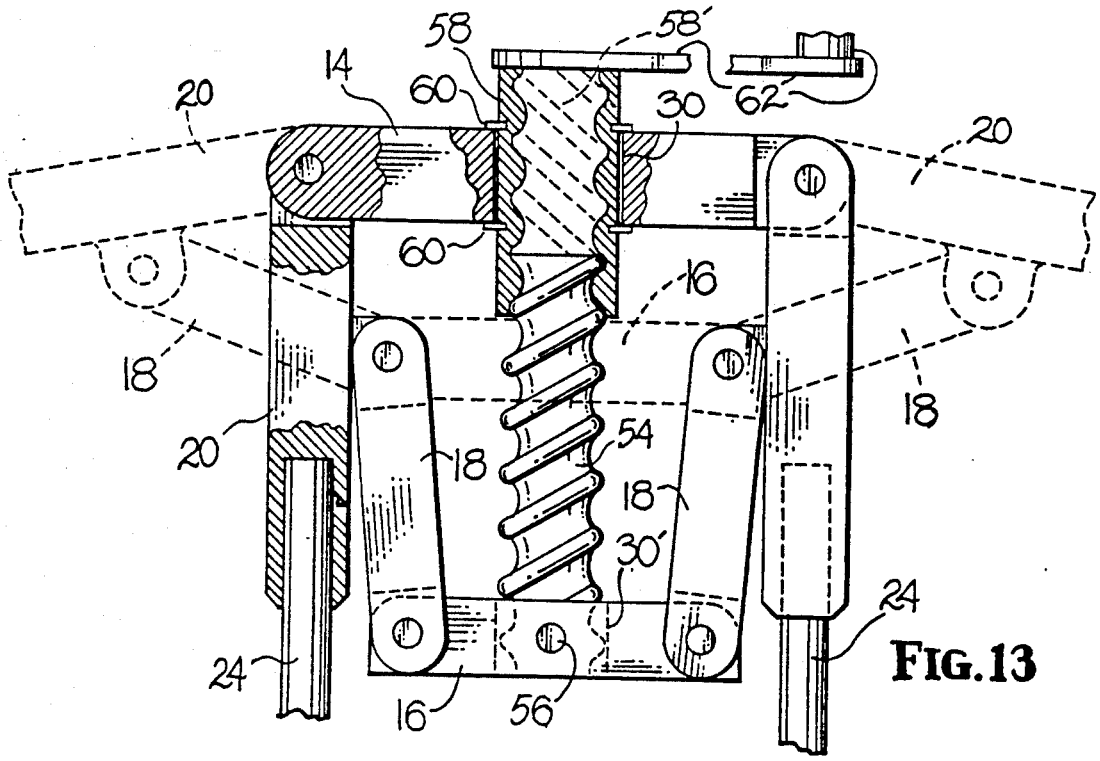
FIG. 13 is a fragmentary, foreshortened side elevation of one embodiment of a preferred drive and lock mechanism utilizing a fixed screw and rotating sleeve arrangement for interconnecting the upper and lower spider members to move the latter toward and away from the other to effect erection and collapse of the tent frame, the erected condition being shown in broken lines.
Figure 14:
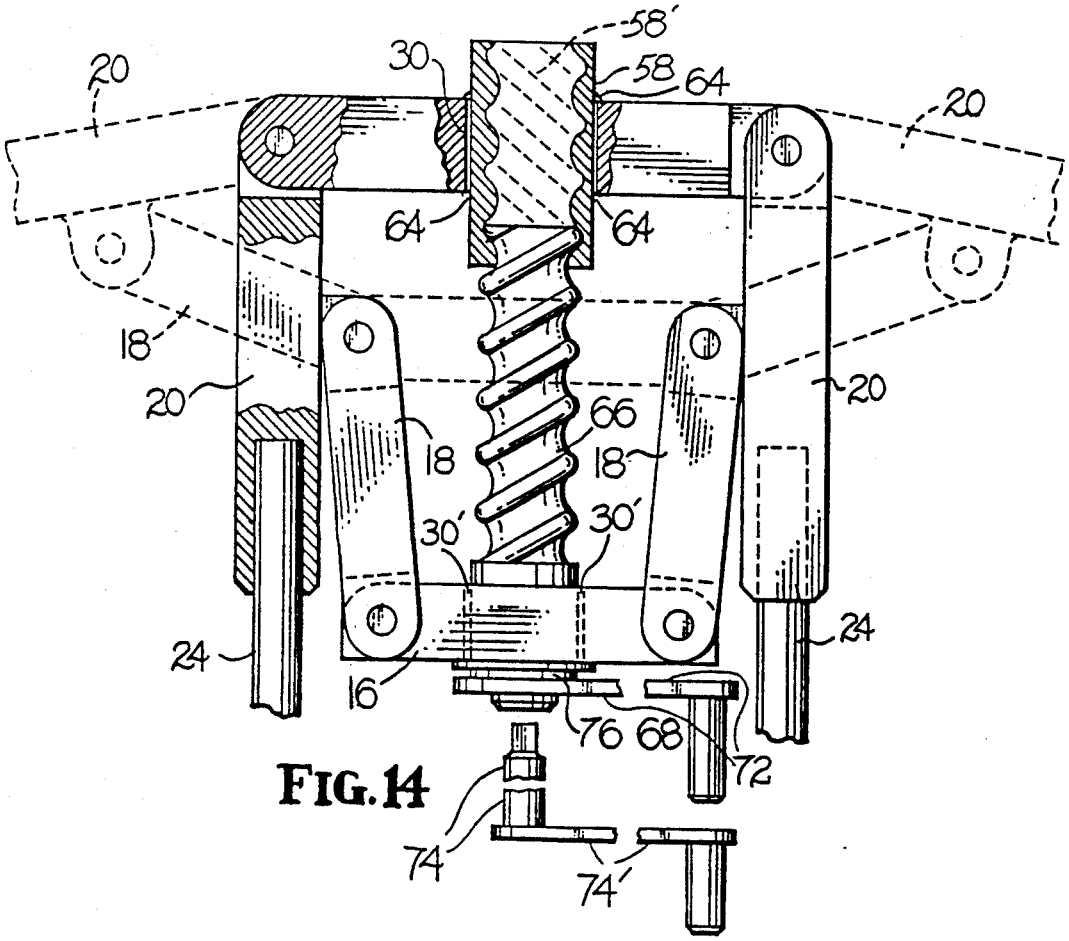
FIG. 14 is a fragmentary, foreshortened side elevation of another embodiment of a preferred drive and lock mechanism utilizing a fixed threaded sleeve and rotating screw crank interconnecting the upper and lower spider members, the erected condition being shown in broken lines.

Referring to the top base assembly shown in FIGS. 13 and 14 of the drawings, there are illustrated two embodiments of drive mechanisms that utilize screw means interconnecting the spiders 14, 16 for mechanically moving them relative to each other, and for releasably locking them in extended condition shown in broken lines. FIG. 13 illustrates top crank assembly primarily intended for smaller tents in which the frame is disposed on the outside of the tent cover, and an individual can reach the crank to operate it. FIG. 14 illustrates a bottom crank assembly which would also find utility in larger tent applications in which the frame would be disposed on the inside of the tent cover, and access to the crank would be gained on the inside of the tent beneath the assembly.

As shown in FIG. 13, each spider has its respective centrally located bore 30, 30', which preferably may be the same diameter so as to permit this embodiment to further enjoy easy reversal of parts for making the assembly either a top or bottom crank model as desired. In this embodiment, an elongated, threaded shaft or screw 54 is secured by a pin 56 to the lower spider, and extends upwardly toward the upper spider. A hollow sleeve 58 having inside threads 58' is received freely through the bore 30 in the upper spider, and retained in place therein by conventional means, such as by the snap rings 60 illustrated. The sleeve mounts a crank handle 62 by which the sleeve may be easily rotated within the bore 30, and the screw 54 is received in the threaded interior of the sleeve. Rotating the sleeve effects threading and unthreading of the screw, and by virtue of the screws rigid attachment to the lower spider, rotation of the sleeve member hence movees the lower spider vertically accordingly. Corresponding inward or outward pivoting movement of the legs is thus accomplished by turning the screw crank 62 in one direction or the other to effect erection or collapse of the tent.

The embodiment illustrated in FIG. 14 is generally similar to the above, but in this case the threaded sleeve 58 is fixed to the upper spider as by welds 64, and the screw 66 is arranged for rotation. Moreover, this embodiment provides for lost motion between the screw and the lower spider, for faster erection of the tent, as will now be explained. In this embodiment, the screw 66 is received freely through the bore 30' in the lower spider 16, and a washer 68 is fixed, as by nut 70 on the opposite side of the spider. A crank 72 is attached to the end of the screw so that turning of the crank effects rotation of the screw and subsequent threading or unthreading of the screw within the threaded interior of the sleeve 58. As the screw is threaded into the sleeve, the lower spider, being supported by the washer 68, is lifted upward.

Since there is no rigid connection between the screw 66 and the lower spider 16, the spider is free to move upward independently of the operation of the screw. This is extremely adventageous during the initial set-up of the tent where it is much quicker to simply lift up on the top base assembly for the majority of the erection process. The crank is then rotated to thread the screw into the sleeve until the washer again engages the already partially raised lower spider 16, and continued rotation of the screw moves the spider its final distance upward against the tension being increasingly exerted as the legs are forced into a more outwardly extended condition against the tent cover as the upper leg-mounting link members are pivoted into their final, fully extended position shown in broken lines.

Also shown is a separate, removable crank 74 having a long extension. This crank may also be a conventional ratchet wrench with an extension piece for convenience. The screw preferably includes a separate opening (not shown) which is configured to receive the end fitting of a ratchet just as a conventional socket receives a ratchet. In cases of larger tents with high ceilings, it may be desirable that a crank extend downwardly so that a person may more easily reach the top base assembly to turn the screw.

Figure 15:
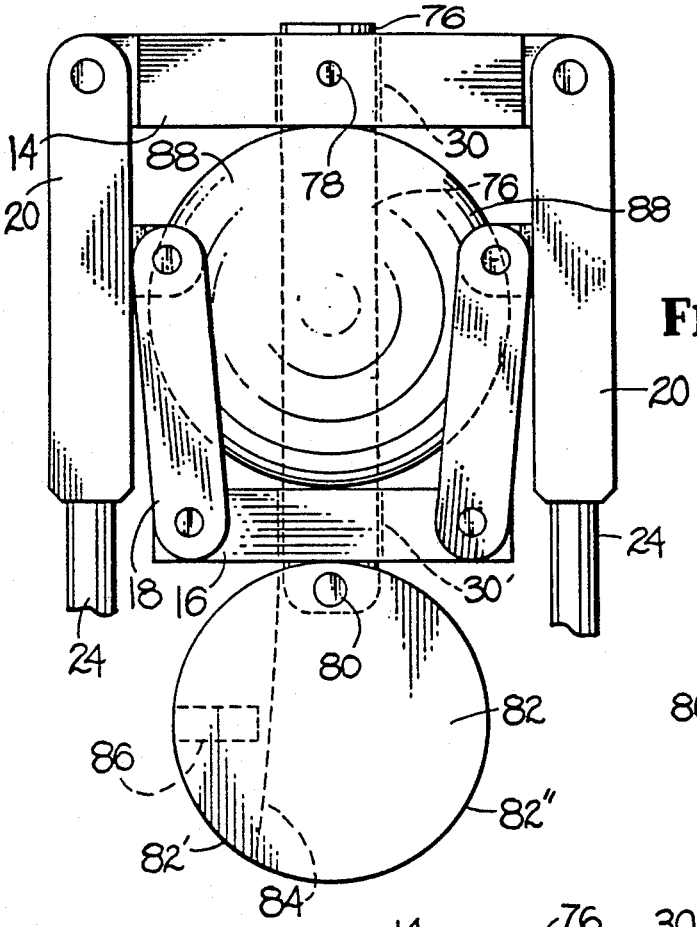
FIG. 15 is a fragmentary side elevation of an alternative, cam operated drive mechanism interconnecting the upper and lower spider members, the assembly shown in collapsed, storage condition.
Figure 17:
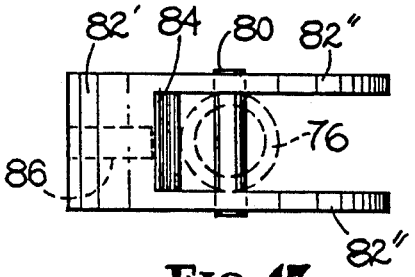
FIG. 17 is a bottom view of the cam member, the view showing the interior configuration of the cam.
Figure 16:
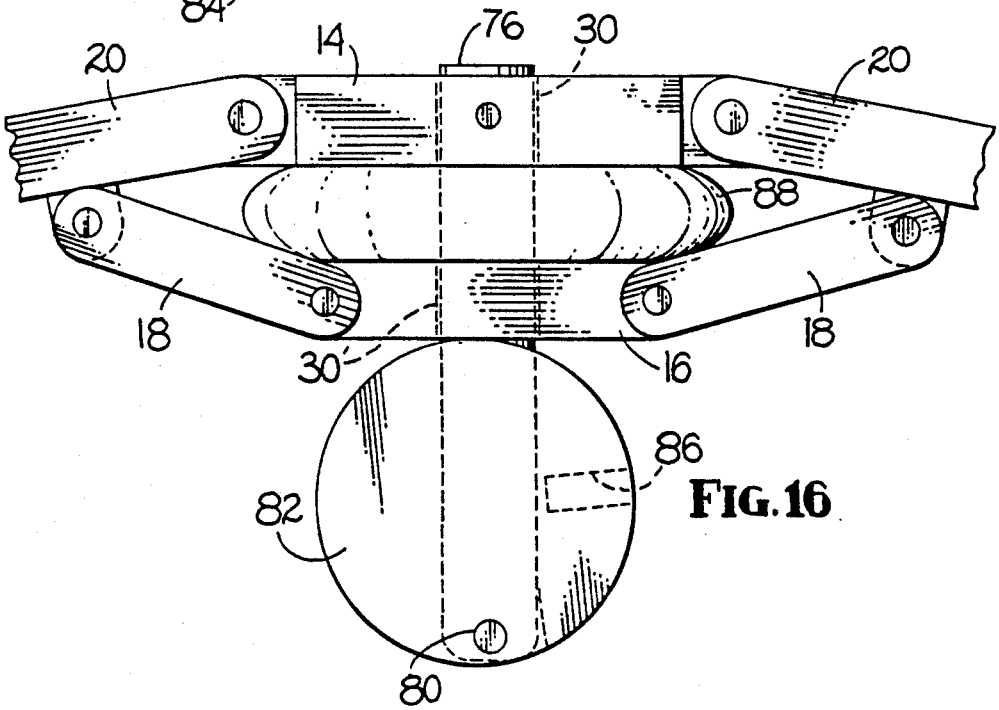
FIG. 16 is a fragmentary side elevation of the cam operated drive mechanism of FIG. 15 but shown in extended condition achieved when the tent is in fully erected condition after the cam has been operated to drive the lower spider member toward the upper spider member.
Figure 20:
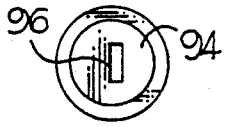
FIG. 20 is a plan view of the bottom cap of the sleeve member shown in FIGS. 18 and 19.
Figure 21:
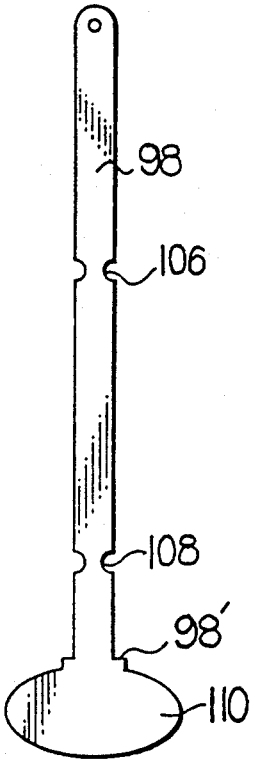
FIG. 21 is a side elevation of the plunger shown in FIGS. 18 and 19.

FIGS. 15 and 16 illustrate another preferred drive means for operating the top base assembly. In this embodiment, a shaft 76 is secured, either by pins 78 shown, welding, or other conventional means, in the bore 30 through the upper spider 14. The shaft 76 extends freely through the bore 30' through the lower spider 16 and mounts, by pivot pin 80 on the opposite side of the lower spider, a cam 82 as shown. The cam is configured substantially as a disc having the center removed (as seen in FIG. 17) so that a portion of it may straddle the shaft 76 when pivoted into the operative condition shown in FIG. 16. The broken line in FIG. 15 indicates the wall 84 dividing the solid portion 82' of the cam from the hollow, open portion comprising two spaced apart walls 82' as shown. The wall 84 is angled so that the cam achieves a final operative position which is over center (FIG. 16) to prevent inadvertent reverse rotation of the cam when in operative condition and subsequent collapse of the tent. A bore 86 is provided to receive a removable rod (not shown) to facilitate hand rotation of the cam.

This embodiment benefits by the provision of a resilient tension means, illustrated herein as a rubber ball 88, between the upper and lower spiders 14, 16. The ball, having a bore therethrough for passage of the shaft 76, encourages downward movement of the lower spider to facilitate collapse of the assembly when the cam is released, and assures a tight abutment of the lower spider against the cam member when is in raised condition, which also serves to prevent inadvertent reverse rotation of the cam when the tent is erected. The ball also exerts outward tension against the link member 18 and 20 to automatically start the assembly in its pivoting action during erection of the tent. Additionally, the ball also prevents fingers from accidentally gaining entrance into the space between the link members where they might get pinched during folding and unfolding of the assembly.

Since there is no direct connection between the cam and the lower spider, the latter is permitted free movement irrespective of the operation of the cam, thus allowing for lost motion and the ability to pivot the legs during the initial stages of erection of the tent without having to operate the cam to do so. Once the tent is partially erected, the cam is then operated to accomplish the final stages of tensioning the framework as has been explained.

Yet another preferred drive means is shown in FIGS. 18–21. In this embodiment, an elongated, hollow sleeve, or barrel 90, is fixed, as by welds 92 within the bore 30 through the upper spider member 14. The sleeve is closed at its bottom end by a cap 94 having a slot 96 therethrough. The lower spider in this embodiment has a smaller bore 30'' therethrough, and a flat bar plunger 98 extends through the bore 30' and the slot 96 and into the confines of the barrel 90. An expansion spring 100 is provided in the barrel, the plunger extending upwardly through the spring which is captured between the bottom cap 94 on the barrel and a plunger cap 102 which is secured to the top of the plunger by pin 104. The spring 100 exerts upward tension on the plunger, the bottom end 98' of which is enlarged to provide an abutting surface which supports the bottom side of the lower spider member. As the spring exerts tension toward the expanded condition shown in FIG. 19, the plunger is raised upward, lifting the lower spider member toward the upper spider.

Figure 18:
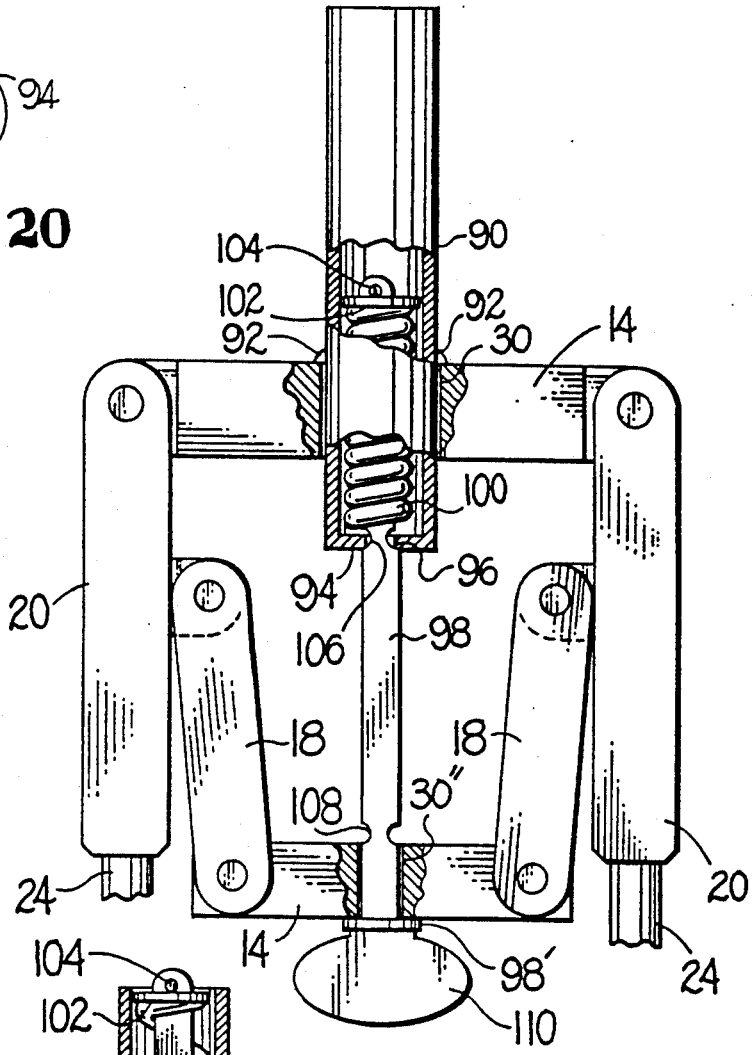
FIG. 18 is a fragmentary side elevation of another alternative drive mechanism utilizing an interconnecting, spring-loaded plunger for moving the lower spider member toward the upper spider member.
Figure 19:
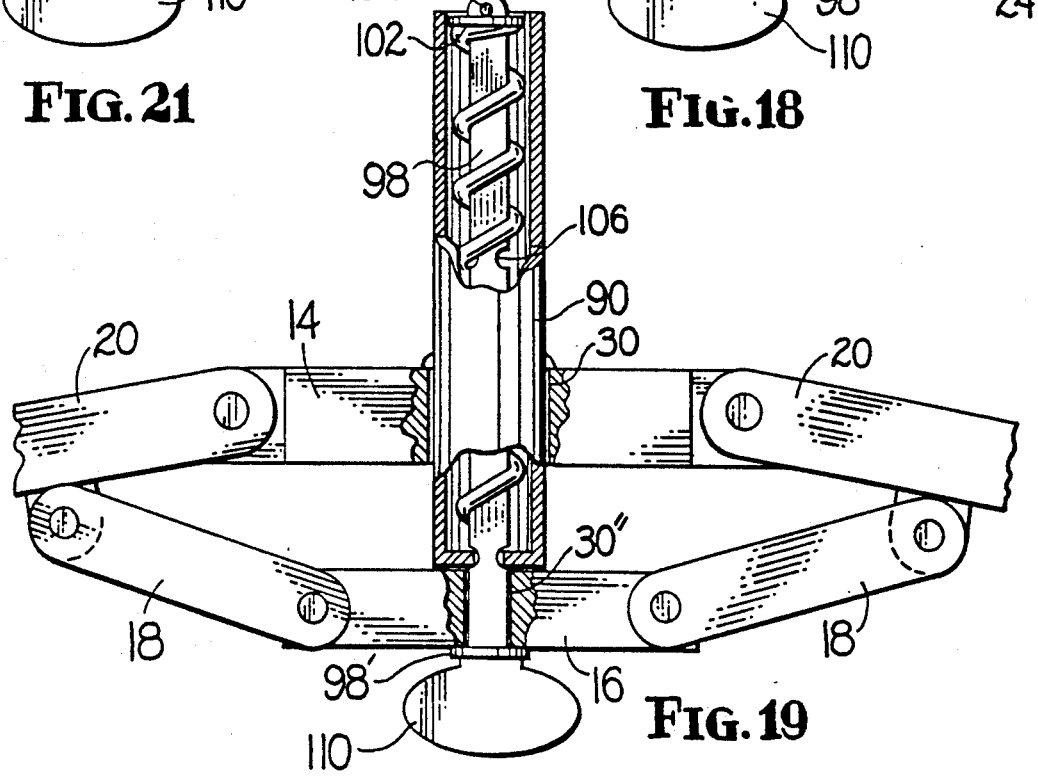
FIG. 19 is a fragmentary side elevation of the drive mechanism of FIG. 18 showing the assembly in extended condition when the tent is in fully erected condition.

The plunger preferably includes two notches 106, 108, spaced apart so that when the plunger is rotated 90°, the notches, when properly aligned, will engage in the slot 96 to lock the plunger in the retracted and extended positions illustrated respectively in FIGS. 18 and 19, thus securing the framework in collapsed or erected condition, an enlarged end 110 on the plunger aids in rotating the plunger between locked and unlocked positions.

The operation of the tent and all of the various disclosed embodiments of its drive means has been carefully detailed hereinbefore. However, from the foregoing it will be appreciated that the erection of the tent of this invention involves simply the unfolding of the legs to which the tent cover is already attached, and then lifting upwards on the top base assembly, and finally operating the particular drive means to fully draw the spider members toward each other which pivots the leg-mounting upper links 20 fully outwardly, automatically tensioning the legs against the confining limits permitted by the tent cover. This erection procedure from beginning to completion taken approximately 30 seconds and involves no particular skill normally required in tent assembly. Collapse of the tent takes slightly longer, perhaps a minute or so, as the framework and cover is manually folded back into the condition of FIG. 1.

From the foregoing, it will be apparent to those skilled in the art that various changes other than those already described, may be made in the size, shape, type, number and arrangement of parts described hereinbefore without departing from the spirit of this invention and the scope of the appended claims.

Having thus described my invention and the manner in which it may be used, I claim:

1. A foldable tent frame, comprising:

a) a plurality of tent frame legs, b) an upper spider member, c) a lower spider member, d) a plurality of upper link members pivoted at their inner ends to the upper spider member and attached at their outer ends to the upper ends of the tent frame legs, e) a plurality of lower link members pivoted at their inner ends to the lower spider member and pivoted at their outer ends ends to the upper link members outwardly of the inner ends of said upper link members, and f) drive means interconnecting the upper and lower spider members for moving said members toward and away from each other, the drive means including a first drive member connected to the upper spider member, a second drive member connected to the first drive member for movement of said first and second drive members one relative to the other, said second drive member engaging said lower spider member and maintaining said upper and lower spider members interconnected during the entire range of movement of said drive and spider members between erected and folded conditions of the tent frame, mechanical operation means engaging one of said first and second drive members for effecting movement of said drive and spider members one relative to the other for erecting the tent frame, and lock means interengaging the first and second drive members for securing the upper and lower spider members together in the erected condition of the tent frame.

2. The foldable tent frame of claim 1 wherein the drive means comprises an elongated threaded shaft member, a threaded sleeve member receiving the threaded shaft member, and means securing the shaft and sleeve members one to the upper spider member and the other to the lower spider member for rotation of one of said shaft and sleeve members relative to the other, and operable upon rotation of the rotatable member in one direction to move the lower spider member upward toward the upper spider member to pivot the upper link members and the tent frame legs outwardly from the upper spider member in a tent frame erecting direction, and upon rotation of the rotatable member in the opposite direction to move the lower spider member downward away from the upper spider member to pivot the upper link members and the tent frame legs inwardly toward the lower spider member in a tent frame folding direction.

3. The foldable tent frame of claim 2 wherein the threaded shaft member is secured to one of the spider members for rotation relative thereto and the sleeve member is secured to the other of the spider members against rotation relative thereto.

4. The foldable tent frame of claim 3 including crank means engageable with the shaft member for rotating said member.

5. The foldable tent frame of claim 2 wherein the threaded sleeve member is secured to the lower spider member for rotation relative thereto and the shaft member is secured to the upper spider member against rotation relative thereto.

6. The foldable tent frame of claim 2 wherein the threaded sleeve member is secured to the upper spider member for rotation relative thereto and the shaft member is secured to the lower spider member against rotation relative thereto.

7. A foldable tent frame, comprising:

a) a plurality of tent frame legs, b) an upper spider member, c) a lower spider member, d) a plurality of upper link members pivoted at their inner ends to the upper spider member and attached at their outer ends to the upper ends of the tent frame legs, e) a plurality of lower link members pivoted at their inner ends to the lower spider member and pivoted at their outer ends to the upper link members outwardly of the inner ends of said upper link members, and f) drive means interengaging the upper and lower spider members for moving said members toward and away from each other, the drive means including lock means for securing the upper and lower spiders together in the erected condition of the tent frame, the drive means comprising:

1) a hollow spring barrel closed at one end and having a locking slot in said closed end, 2) an elongated plunger rod extending slidable through the locking slot and projecting outwardly through said closed end, 3) a coil spring encircling the plunger rod within said spring barrel and bearing at one end against the inner side of the closed end of said barrel, 4) spring stop means on the end of the plunger rod in said spring barrel and bearing against the opposite end of the coil spring, 5) the spring barrel being secured to one of the upper and lower spider members and the plunger rod projecting from the closed end of the barrel extending slidably through an opening in the other of said upper and lower spider members, 6) abutment means on the end of the plunger rod projecting outwardly from the other of said upper and lower spider members for engaging the latter, and 7) first and second locking stop means spaced apart longitudinally on the plunger rod and arranged upon rotation of the rod to releasably engage the closed end of the barrel one in the compressed condition of the spring and the other in the extended condition of the spring.

8. A foldable tent frame, comprising:

a) a plurality of tent frame legs, b) an upper spider member, c) a lower spider member, d) a plurality of upper link members pivoted at their inner ends to the upper spider member and attached at their outer ends to the upper ends of the tent frame legs, e) a plurality of lower link members pivoted at their inner ends to the lower spider member and pivoted at their outer ends to the upper link members outwardly of the inner ends of said upper link members, f) drive means interconnecting the upper and lower spider members for moving said members toward and away from each other and maintaining said spider members interconnected during said movement, the drive means including lock means for securing the upper and lower spiders together in the erected condition of the tent frame, and g) a resilient member interposed between the upper and lower spider members and arranged to be compressed by said spider members as they are moved toward each other against the resilient resistance of said resilient member.

9. The foldable tent frame of claim 8 wherein the resilient member is arranged to engage and exert resilient outward pressure against the upper link members during compression of the resilient member between the spider members.

10. A foldable tent frame, comprising:

a) a plurality of tent frame legs, b) an upper spider member, c) a lower spider member, d) a plurality of upper link members pivoted at their inner ends to the upper spider member and attached at their outer ends to the upper ends of the tent frame legs, e) a plurality of lower link members pivoted at their inner ends to the lower spider member and pivoted at their outer ends to the upper link members outwardly of the inner ends of said upper link members, and f) drive means interconnecting the upper and lower spider members for moving said members toward and away from each other and maintaining said spider members interconnected during said movement, the drive means including lock means for securing the upper and lower spiders together in the erected condition of the tent frame, the drive means comprising an elongated hollow sleeve member secured to the upper spider member, an elongated plunger member extending through the lower spider member into and movable longitudinally in said sleeve member, latch means on the plunger member and sleeve members for securing the plunger member releasably to the sleeve member in the erected and folded conditions of the tent, and spring means in the sleeve member engaging the plunger member and urging the plunger member resiliently into the sleeve member for driving the tent frame toward erected condition.

11. A foldable tent frame, comprising:

a) a plurality of tent frame legs, b) an upper spider member, c) a lower spider member, d) a plurality of upper link members pivoted at their inner ends to the upper spider member and attached at their outer ends to the upper ends of the tent frame legs, e) a plurality of lower link members pivoted at their inner ends to the lower spider member and pivoted at their outer ends to the upper link member outwardly of the inner ends of said upper link members, and f) drive means interconnecting the upper and lower spider members for moving said members toward and away from each other and maintaining said spider members interconnected during the entire range of movement of said members between erected and folded conditions of the tent frame, the drive means comprising an elongated shaft secured at its upper end to the upper spider member and extending slidably through an opening in the lower spider member, and cam means secured pivotally to the shaft below the lower spider member and engaging the lower surface of the lower spider member and operable upon rotation in one direction to move the lower spider member upward toward the other spider member to pivot the upper link members and tent frame legs outwardly from the upper spider member in a tent frame erecting direction, and upon rotation in the opposite direction to move the lower spider member downward away from the upper spider member to pivot the upper link members and the tent frame legs inwardly toward the lower spider member in a tent frame folding direction, the drive means including lock means for securing the upper and lower spider members together in the erected condition of the tent frame.

12. The foldable tent frame of claim 11 wherein the cam means is rotatable through an arc slightly greater than 180° from the position in which it spaces the lower spider member farthest from the upper spider member in the folded condition of the tent frame to the position in which it spaces the lower spider member closest to the upper spider member in the erected condition of the tent frame.

* * * * *

UNITED STATES PATENT AND TRADEMARK OFFICE

CERTIFICATE OF CORRECTION

PATENT NO. : 5,230,358

DATED : 27 July 1993

INVENTOR(S) : MILTON D. FORELL

It is certified that error appears in the above-identified patent and that said Letters Patent is hereby corrected as shown below:

Column 8, line 30, "sleeve" should read --shaft--.

Column 8, line 31, "shaft" should read --sleeve--.

Signed and Sealed this

Twenty-ninth Day of March, 1994

Bruce Lehman

*Attest:*

BRUCE LEHMAN

*Attesting Officer*

*Commissioner of Patents and Trademarks*